United States Patent [19]

Markham

[11] Patent Number: 5,035,385

[45] Date of Patent: Jul. 30, 1991

[54] CLOSURE MEANS AND HOLDER FOR TOOTHPASTE TUBE

[76] Inventor: Brandon L. Markham, 1149 Stillwell Rd., Belle Glade, Fla. 33430

[21] Appl. No.: 486,411

[22] Filed: Feb. 28, 1990

[51] Int. Cl.[5] ..... B65D 35/00

[52] U.S. Cl. ..... 248/108; 248/111

[58] Field of Search ..... 248/108, 109, 272, 205.3, 248/110, 111

[56] References Cited

U.S. PATENT DOCUMENTS

| | | | |
|---|---|---|---|
| D. 239,748 | 5/1976 | Mellon et al. . | |
| 1,072,940 | 9/1913 | Goppelt, Jr. | 248/108 |
| 1,272,848 | 7/1918 | Plack | 248/272 |
| 1,280,956 | 10/1918 | Brand | 248/108 |
| 1,384,307 | 7/1921 | Daniel | 248/108 |
| 1,399,580 | 12/1921 | Rothrock | 248/108 |
| 1,608,055 | 11/1926 | Brownlee | 248/108 |
| 1,703,951 | 3/1929 | Owen | 248/272 |
| 1,807,083 | 5/1931 | Bracey et al. | 248/108 |
| 2,667,287 | 1/1954 | Cook | 248/108 X |
| 3,180,528 | 4/1965 | Balint et al. . | |
| 3,190,500 | 6/1965 | Miles . | |
| 3,304,039 | 2/1967 | Edelman et al. . | |
| 3,931,950 | 1/1976 | Javillonar | 248/108 |
| 4,203,567 | 5/1980 | Featherstone | 248/108 |
| 4,294,365 | 10/1981 | Henderson | 248/205.3 X |

FOREIGN PATENT DOCUMENTS

| | | | |
|---|---|---|---|
| 700570 | 12/1940 | Fed. Rep. of Germany | 248/108 |
| 198173 | 5/1923 | United Kingdom | 248/108 |

*Primary Examiner*—David L. Talbott

*Attorney, Agent, or Firm*—Julian C. Renfro

[57] ABSTRACT

A toothpaste tube holder for supporting a toothpaste tube in a generally horizontal attitude in accordance with this invention involves a generally flat, rectangularly-shaped base member having a front face and a rear face. A pair of similarly-sized support arms are attached in a generally aligned, spaced relationship to the front face, with the rear face being configured for attachment to a generally vertically disposed supporting surface. One of the arms has a fixedly attached cap thereon, and the other arm has therein a tube receiving portion. The cap has a tapered interior, configured to receive the nozzle from which toothpaste is dispensed from the toothpaste tube. Therefore, upon the user discarding the original cap of the toothpaste tube, the cap of the one arm can serve as the closure for the nozzle, as well as the support for that end of the toothpaste tube. The receiving portion of the other arm of the holder serves to receive and support the closed end of the toothpaste tube. In accordance with the preferred embodiment, the arms are demountable, with the arm equipped with the cap being able to be installed on either end of the front face of the base member.

11 Claims, 2 Drawing Sheets

FIG 1
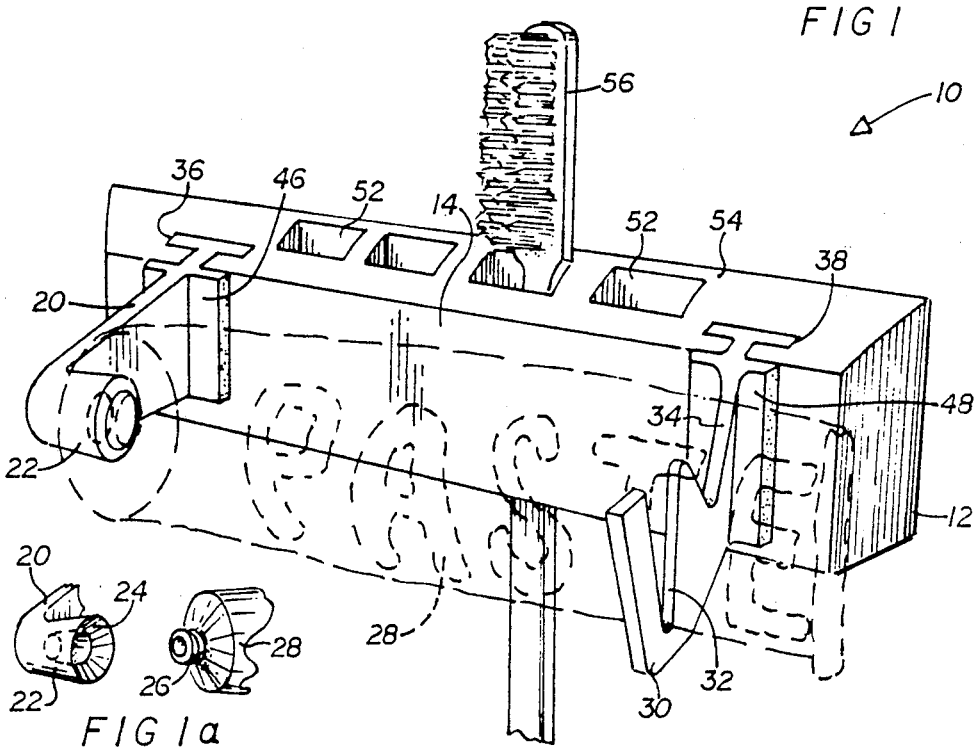
FIG 1a
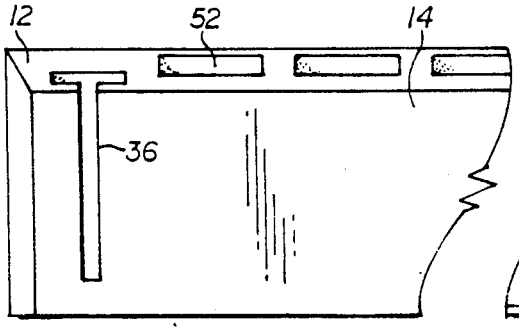
FIG 2
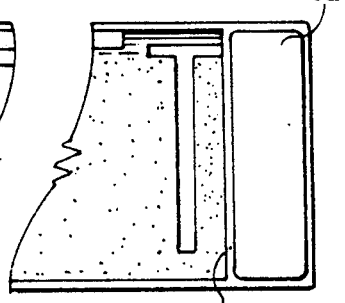
FIG 2a
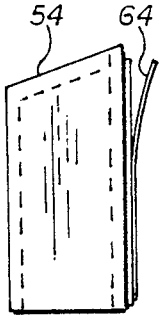
FIG 3
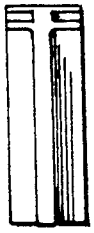
FIG 4a
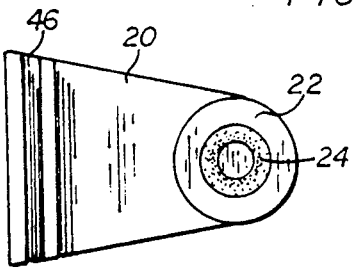
FIG 4b
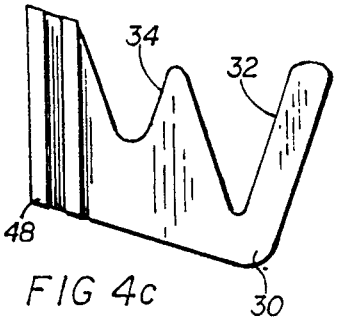
FIG 4c

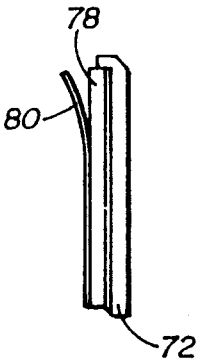
FIG 6
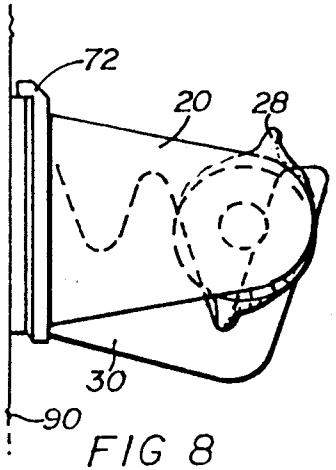
FIG 8
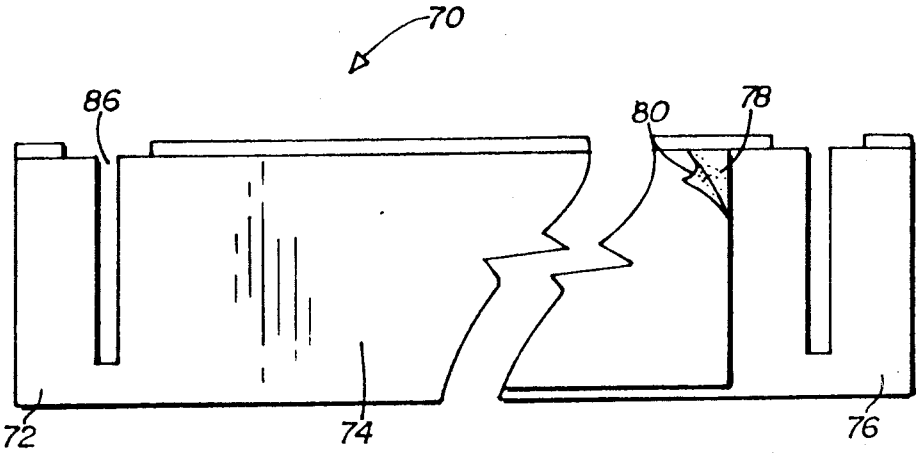
FIG 5a
FIG 5
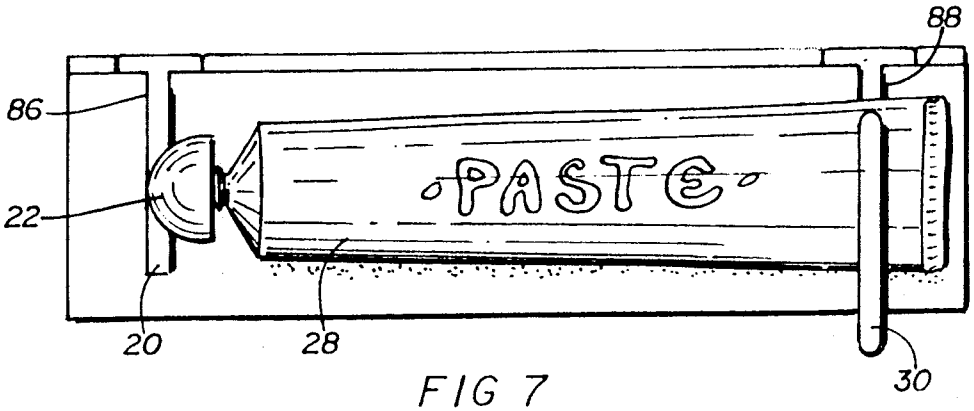
FIG 7

CLOSURE MEANS AND HOLDER FOR TOOTHPASTE TUBE

BACKGROUND OF THE INVENTION

Conventional toothpaste tubes are generally not provided with any means for easily storing such tubes when they are not being used. Furthermore, the closure cap for the tube frequently becomes lost. It has become conventional to store toothpaste tubes in relatively inaccessible locations, such as in medicine cabinets, on a shelf, or even on the side edge of the lavatory. This results in valuable storage space being expended, as well as placing the toothpaste tube in a location somewhat removed from the toothbrushes, which are usually suspended on a rack near the medicine cabinet. A more advantageous place to store toothpaste tubes would be afforded by a rack arrangement which further provides for closure of the tube, and for the storage of tooth brushes.

The prior art is replete with various hangable tube devices, which comprise, for example, supporting elements in the form of brackets, eyes, rings, tethers and the like. However, these devices have met with only limited success, for in the most part they comprise elements which must be attached to the tube, either at its crimped end or adjacent the dispensing nozzle, or in some combination with the closure cap. In these known devices, quite often the supporting member itself ruptures the tube while it is being applied or while in use. In addition, substantially all of the known devices require a particular member affixed to a wall from which the tube is hung.

As is known, tubes for toothpaste and the like typically include a substantially cylindrical tubular body portion, one end of which is sealed by the conventional method of folding and crimping, and the other involving a relatively rigid shoulder portion of generally conical configuration, that terminates in a nozzle portion from which the contents of the tube may be dispensed. Since preparations normally packaged in tubes of this type ordinarily find their principal environment in the bathroom of the home, provisions are made in the form of medicine chests or cabinets within which such devices and other supplies are normally stored. In most instances shelf space in such cabinets is quite limited, and certain ones of the articles frequently must be removed from the cabinet prior to gaining access to the desired one. It is therefore highly desirable that the toothpaste tube be stored in such a manner as to afford a maximum ease of use, while at the same time occupying a minimum of shelf space.

SUMMARY OF THE INVENTION

In accordance with this invention, a highly effective combination of a closure means, and a holder for supporting a toothpaste tube in a generally horizontal attitude is provided. As will be seen hereinafter in greater detail, my invention entails a toothpaste holder that is typically mounted on the wall or on a low stand on the lavatory or counter, on one arm of which toothpaste holder is fixedly mounted a cap that has a tapered interior.

In use, the original cap for the toothpaste tube is discarded, and the fixed cap of my novel toothpaste holder is thereafter used each time resealing of the toothpaste tube is to be brought about. In other words, my toothpaste holder utilizes a pair of support arms, with one arm containing a closure for the closed end of the tube, such that the toothpaste tube is held in the desired horizontal position by the pair of arms.

The person thereafter using my invention merely has to lift the toothpaste tube away from the holder, and then squeeze the tube in order to apply toothpaste to the brush from the dispensing orifice of the toothpaste tube. Then the user inserts the threaded end of the toothpaste tube back into the tapered interior of the fixed cap in order to accomplish the resealing of the tube.

It is, therefore, a general object of this invention to provide an improved holder for a collapsible tube for a product such as toothpaste, in combination with a fixed cap having a tapered interior, thus making it readily possible for the user to remove the tube from the holder and uncap it in one simple action, and thereafter to recap the tube and place it in a suitable storage position in another simple action.

It is another object to provide a toothpaste tube closure and support device utilizing a base member and a pair of arms extending outwardly therefrom, which is simple in construction, practical in its application, economical to fabricate, and easy to maintain.

It is yet another object of the present invention to provide a novel holder utilizing arms capable of supporting a toothpaste tube in a generally horizontal attitude, with one arm incorporating a closure cap that cannot be lost or misplaced.

It is still another object of the invention to provide an improved dispensing tube holder capable of being stored out of contact with medicine cabinet shelves, thereby making possible maximum use of the storage space, this being accomplished by storing the tube in a space which would not normally be occupied.

It is still another object of the present invention to provide a toothbrush holder and reclosure arrangement for the storing of tubes of toothpaste, which device does not occupy appreciable storage space, yet placing the tube of toothpaste as well as toothbrushes in an easily accessible location.

These and other objects, features and advantages will become more apparent as the description proceeds.

BRIEF DESCRIPTION OF DRAWINGS

FIG. 1 is a perspective view of a typical closure means and holder for toothpaste tube in accordance with a first embodiment of my invention, revealing in phantom outline, a toothpaste tube supported in a generally horizontal attitude by a pair of arms that are in turn supported from a novel base member;

FIG. 1*a* is a fragmentary view of the threaded end of a typical toothpaste tube, residing alongside the novel closure cap I utilize with each embodiment of my toothpaste tube holder, which cap has a tapered interior;

FIG. 2 is a fragmentary view of the first embodiment of my novel base member, in which an arm supporting slot as well as several vertically disposed slots or apertures for toothbrushes are visible from the front side of the base member;

FIG. 2*a* is a fragmentary view of the rear side of the base member revealed in FIG. 2, showing support means enabling the base member to be supported from a wall or stand;

FIG. 3 is an edge view of the base member depicted in FIGS. 1, 2 and 2*a*, revealing how the backer material can be peeled away from contact adhesive or the like at the time the user wishes to mount the base member on the wall;

FIG. 4*a* is a fragmentary view of the "H" shaped support portion for an arm, which portion is of course intended to be slid into one of the pair of configured slots utilized on the front side of the base member;

FIG. 4*b* is a side view of the interior side of the support arm, upon the end of which the closure cap is formed or mounted;

FIG. 4*c* is a side view of the other support arm, which is notched to receive the crimped end of the toothpaste tube;

FIG. 5 is a fragmentary view of a second embodiment of my novel base member, in which no vertically disposed toothbrush supporting slots are utilized, with an arm supporting slot being visible from the front side of the base member;

FIG. 5*a* is a fragmentary view of the rear side of the base member revealed in FIG. 5, showing support means enabling the base member to be supported from a wall or stand;

FIG. 6 is an edge view of the base member depicted in FIGS. 5 and 5*a*, revealing how the backer material can be peeled away from contact adhesive or the like at the time the user wishes to mount the base member on the wall;

FIG. 7 is a frontal view, revealing how a toothpaste tube is typically supported from a pair of arms mounted on the front face of the second embodiment of my novel closure means and holder for a toothpaste tube; and FIG. 8 is an end view of the device depicted in FIG. 7, but showing a typical relationship of the arms that support the toothpaste tube with respect to a vertical surface.

DETAILED DESCRIPTION

With initial reference to FIG. 1, it will there be seen that I have shown a toothpaste tube holder 10 in accordance with the first embodiment of my invention, which primarily involves a generally flat, rectangularly-shaped base member 12 preferably made of hard ABS plastic, although I am not to be limited to this material. The base member 12 has a front face 14 and a rear face 16, with the front face being concerned with the mounting thereon of a pair of similarly sized arms 20 and 30 that are concerned with supporting a toothpaste tube or the like in a generally horizontal attitude. The rear face 16 of the base member 12 is concerned with the mounting of the base member 12 on a suitable supporting surface, and this will be discussed hereinafter.

As will be noted from FIG. 1, the arm 20 is equipped with a cap 22 thereon, which has a tapered interior 24, as revealed in FIG. 1*a*. The tapered interior of the cap 22 is designed to receive the nozzle or threaded end 26 of a tube 28 of toothpaste after the user has discarded the cap originally furnished with the tube of toothpaste.

As will be made more clear hereinafter, the arm 20 and its cap 22 is concerned with supporting one end of the toothpaste tube, whereas the other arm 30 is concerned with supporting the other or crimped end of the toothpaste tube. To that end at least one notch 32 is provided in the arm 30, but preferably two notches are utilized, as revealed in FIGS. 1 and 4*c*. The second notch, notch 34, is preferably not as deep as notch 32, as will hereinafter be discussed.

An option in the construction of my novel tube holder is to have the arms 20 and 30 fixedly mounted to the base member 12, such being a relatively inexpensive version of my invention. I prefer, however, to provide a pair of supporting means in spaced apart locations on the front face 14 of the base member, to receive the base or mounting portions of the arms 20 and 30. By having removable arms, the user can select the location on the front face 14 of the base member 12 where the arm 20 and its cap 22 will be installed, which obviously is not an option if the arms are fixed on the base member at the factory. Another advantage of having demountable arms is that my tube holder device can be shipped and sold in a smaller, flatter package than is possible with devices having fixed arms.

With regard to the preferred arrangement, in which the arms 20 and 30 are demountable, I prefer to provide a pair of carefully configured slots or notches 36 and 38, generally of a "T" shaped configuration, to serve as the supporting means for the arms 20 and 30. The slots or notches are utilized at spaced apart locations on the front face 14 of the base member, typically placed near the respective ends of the base member 12. These slots or notches are discernible in FIG. 1, and into each of these two slots 36 and 38 is inserted the base portion or mounting means of an arm concerned with toothpaste tube support. In this particular instance the support arm 20 is shown on the left end of the base member 12, with its mounting portion or base portion 46 being slidably received in notch or slot 36. The mounting portion or base portion 48 of the support arm 30 is shown on the right end of the base member 12, with this mounting portion or base portion being slidably received in notch or slot 38.

By way of example, I may use base portions 46 and 48 for the arms 20 and 30 that in plan view have "H" shaped cross-sections, as generally indicated in FIGS. 4*a*, 4*b* and 4*c*, with the web or mid portions of the base portions of these arms being configured so as to be tightly received in either of the configured slots 36 and 38.

The tight fit of the base portions 46 and 48 in the slots 36 and 38 is clearly depicted in FIG. 1. The bottom ends of the slots 36 and 38 terminate just above the bottom of the base member 12, so that the support members or base members of the arms cannot slide entirely through. Because some users of my device are left handed, and some are right handed, I prefer to have the support means for the arms that are insertable into the slots 36 and 38 to be readily removable as well as interchangeable, so that a given arm can be mounted in the configured slot or notch located in either end of the base member 12.

Also to be noted in the embodiment illustrated in FIG. 1 is the provision of a plurality of slots or apertures 52 for toothbrushes, which are spaced along the sloped upper edge 54 of the base member 12, with this figure also revealing a toothbrush 56 residing in one of these vertically disposed slots or apertures. The slots or apertures 52 for the toothbrushes typically extend entirely through from top to bottom, with the handle of the toothbrush 56 extending below the base member 12.

Returning to a discussion of the details of the support arms, it was previously made clear that the cap 22 is fixedly attached to the end of arm 20, with it to be understood that the tapered interior 24 of the cap 22 is always oriented on the front face 14 such that it faces toward the arm 30 that contains the notches 32 and 34 when my tube holder is to be utilized; note FIG. 1.

The tapered interior 24 of the cap 22 is regarded as being of "universal" size; note FIG. 4*b*. Rather than being equipped with interior threads of the type typically to be found in a toothpaste tube cap, the cap 22 that I use on arm 20 preferably has a effectively tapered interior portion such that the threaded end or nozzle portion 26 of a toothpaste tube 28 can readily be inserted into the cap and then retained therein. Although a good friction fit of the threaded end 26 of a toothpaste tube into the interior 24 of the cap 22 is usually achieved, I depend upon the use of the support arm 30 on the other end of the base member 12 to assist in holding the toothpaste tube 28 in the desired, substantially horizontal position depicted in FIG. 1. The tapered interior portion 24 of the cap 22 is configured to receive the nozzle portion of a wide range of sizes of toothpaste tubes.

The support arm 30 is of a different configuration than is arm 20, although the two arms are similarly sized, and they are utilized in a generally aligned, spaced relationship on the front face of the tube holder. As previously mentioned, the arms 20 and 30 may be interchangeably utilized on the front face 14 by virtue of both having identically shaped base portions or mounting means 46 and 48 that are readily accepted in either of the slots or notches 36 and 38.

The support arm 30 will be seen from FIGS. 1 and 4*c* to involve the previously mentioned relatively deep notch 32 as well as a relatively shallow notch 34, with the relatively shallow notch being closer to the end of the arm designed to be received in the generally "T" shaped slot 36 or 38 of the base member 12.

The relatively deep notch 32 is designed to receive the crimped end of the toothpaste tube 28, and to keep it substantially vertical during storage of the tube on my device. The crimped end of course is the end remote from the generally conically shaped end from which toothpaste is dispensed. Advantageously, the relatively deep notch 32 of the arm 30 is designed to keep the wider cross section of the toothpaste tube approximately vertical, irrespective of the fact that the tube is relatively full or relatively empty. The reason why it is desirable to keep the wider cross section of the tube vertical is that such allows ease of grasping. Also, grasping under this circumstance can be accomplished while the hand is in a comfortable position.

The relatively shallow notch 34 in the arm 30 permits the momentary entry of the user's finger as he or she is grasping the tube of toothpaste.

Presuming the toothpaste tube 28 is maintained in the essentially horizontal attitude depicted in FIG. 1 (and FIG. 7), the cap 22 with its tapered interior recess 24 will support the threaded end 26 of the toothpaste tube quite well, and achieve a sufficient sealing of the end as to prevent the contents of the tube drying out.

The use of the my invention thus means that upon deployment of my device, the screw-on cap originally supplied with the tube of toothpaste can be discarded, and thereafter the cap 22 with its tapered interior 24 utilized in the closure of the nozzle end of the toothpaste tube 28. Because the arm 20 is easy to remove from the base member 12, cleaning out of errant toothpaste from the tapered interior 24 of the cap 22 can readily be accomplished whenever needed.

The base member 12 can readily be supported from the bathroom wall, for example, or it can be supported from a small stand located upon the washstand, alongside the lavatory or sink. I prefer to provide the base member 12 with a flat rear face or rear side 16, upon which pressure sensitive adhesive 62, for example, can be utilized, as depicted in FIG. 2*a*. Backer material 64 is to be placed on the pressure sensitive adhesive 62 at the factory, where it is to remain until such time as the base member is actually ready to be mounted on the wall or other surface. The backer material 64 is then to be peeled away, as depicted in FIG. 3.

The base member 12 is shown in FIG. 3 to have a degree of depth, but such is not a firm requirement of my invention. Should it not be desired to utilize slots or apertures 52 on the rear edge of the base member to receive toothbrushes, the base member can be comparatively thin, as depicted in the embodiment of my invention illustrated in FIGS. 5 through 8.

With reference now to FIG. 5, it will there be seen that I have shown a toothpaste tube holder 70 in accordance with the second embodiment of my invention, which primarily involves a generally flat, rectangularly-shaped base member 72 preferably made of hard ABS plastic, although I am not to be limited to this material. The base member 72 has a front face 74 and a rear face 76, with the front face being concerned with the mounting thereon of the pair of similarly sized arms 20 and 30 earlier described as being concerned with supporting a toothpaste tube or the like in a generally horizontal attitude. The rear face 76 of the base member 72 is concerned with the mounting of the base member 72 on a suitable supporting surface, such as a bathroom wall, on a wash stand, or on some other appropriate vertical surface.

As in the first embodiment of the base member, this second embodiment of the base member has slots 86 and 88 to receive the base portions of the arms 20 and 30, with it to be understood that the bottom ends of the slots 86 and 88 terminate just above the bottom of the base member 72, so that the support portions or base members of the arms 20 and 30 cannot slide entirely through. As in the first embodiment, the support means for the arms are insertable into the slots 86 and 88 so as to be readily removable as well as interchangeable, so that a given arm can be mounted in the configured slot or notch located in either end of the base member 72.

Absent of course from this second embodiment of my invention is the provision of a plurality of slots or apertures for toothbrushes, for this second embodiment is characterized by the relative flatness of the base member 72, as best seen in FIG. 6.

The base member 12 can readily be supported from the bathroom wall, for example, or it can be supported from a small stand located upon the washstand, alongside the lavatory or sink, by the use of adhesive means. I prefer to provide the base member 72 with a flat rear face or rear side 76, upon which pressure sensitive adhesive 78, for example, can be utilized, as depicted in FIGS. 5*a* and 6. Backer material 80 is to be placed on the pressure sensitive adhesive 78 at the factory, where it is to remain until such time as the base member is actually ready to be mounted on the wall or other surface. The backer material 80 is then to be peeled away, as depicted in FIGS. 5*a* and 6.

Inasmuch as I have previously described that I prefer for the supporting arms 20 and 30 to have base portions 46 and 48 that in plan view have "H" shaped cross-sections, as generally indicated in FIGS. 4*a*, 4*b* and 4*c*, I prefer for the adhesive means utilized on the backside of the base member to cause the base member 72 to stand away from the wall 90 a bit, in the manner revealed in FIG. 8, so as to make it readily possible for the base portions 46 and 48 to be readily slidable into the slots or notches 86 and 88 utilized in the base member 72.

With continuing reference to FIG. 8, it will be seen that I have shown the arm 30 in what may be regarded as the background, and the arm 20 in what may be regarded as the foreground, so as to reveal that the arms are similarly sized and utilized in a generally aligned relationship. As made clear from FIG. 8, however, inasmuch as it is desired for the tube of toothpaste to be supported in a generally horizontal position on the arms, I may configure the notched arm 30 to extend a bit lower than the arm 20, to compensate for the bottom end or crimped end of the toothpaste tube being generally wider than the nozzle end of the tube.

To give the user some options, I may also place mounting holes in spaced relation on the backside or rear face of either version of the base member, such that the base member may be readily received upon a suitably spaced pair of nail heads or screw heads protruding slightly from the wall, such that it will be supported in the desired, substantially horizontal position on the wall.

I claim:

1. A toothpaste tube holder for supporting a toothpaste tube in a generally horizontal attitude, said holder comprising a generally flat, rectangularly-shaped base member having a front face and a rear face, a pair of similarly-sized support arms mounted in a generally aligned, spaced relationship upon said front face, said arms being removable, and each arm having mounting means thereon, said front face of said holder having a spaced apart pair of supporting means for receiving said mounting means provided upon said arms, and means on said rear face for attachment of the holder to a generally vertically disposed supporting surface, one of said arms having a fixedly attached cap thereon, and the other arm having thereon a tube receiving means, said cap having a tapered interior, configured to receive the nozzle from which toothpaste is dispensed from the toothpaste tube, such that upon the user discarding the original cap of the toothpaste tube, the cap of said one arm can serve as the closure for the nozzle, as well as the support for that end of the toothpaste tube, whereas said receiving means of said other arm of said holder serves to receive and support the closed end of the toothpaste tube.

2. The toothpaste tube holder as recited in claim 1 in which a plurality of vertically disposed slots or apertures are provided between said front and said rear faces, for receiving the handles of toothbrushes.

3. The toothpaste tube holder as recited in claim 1 in which either arm may be mounted on either end of said front face.

4. The toothpaste tube holder as recited in claim 1 in which said front face of said base member has supporting means in the form of a pair of generally vertically disposed slots therein, whereas each of said arms has a mounting means of uniform size, configured so as to be slidable into one or the other of said slots, this arrangement permitting the user to install the arm with the fixedly attached cap in either slot of said front face, with the tapered interior of said cap in either instance facing said other arm.

5. The toothpaste tube holder as recited in claim 1 in which adhesive means are provided on the rear face of said base member, so that said base member can be caused to adhere to the generally vertically disposed supporting surface.

6. A toothpaste tube holder for supporting a toothpaste tube in a generally horizontal attitude, said holder comprising a generally flat, rectangularly-shaped base member having a front face and a rear face, a pair of similarly-sized arms removably attachable in a slidable manner in a generally aligned, spaced relationship to said front face, with means on said rear face for attachment of the holder to a generally vertically disposed supporting surface, one of said arms having a fixedly attached cap thereon, and the other arm having therein an upstanding notch, said cap having a tapered interior, configured to receive the nozzle from which toothpaste is dispensed from the toothpaste tube, such that upon the user discarding the original cap of the toothpaste tube, the cap of said one arm can serve as the closure for the nozzle, as well as the support for that end of the toothpaste tube, whereas said notch of said other arm of said holder serves to receive and support the closed end of the toothpaste tube.

7. The toothpaste tube holder as recited in claim 6 in which a plurality of vertically disposed slots are provided between said front and said rear faces, for receiving the handles of toothbrushes.

8. The toothpaste tube holder as recited in claim 6 in which each of said arms has mounting means thereon, and said front face of said holder has a spaced apart pair of supporting means for receiving said mounting means provided upon said arms.

9. The toothpaste tube holder as recited in claim 8 in which either arm may be mounted on either end of said front face.

10. The toothpaste tube holder as recited in claim 6 in which said front face of said base member has a pair of generally vertically disposed slots therein, whereas each of said arms has a base portion of uniform size, configured so as to be slidable into one or the other of said slots, this arrangement permitting the user to install the arm with the fixedly attached cap in either slot of said front face, with the tapered interior of said cap in either instance facing said other arm.

11. The toothpaste tube holder as recited in claim 6 in which adhesive means are provided on the rear face of said base member, so that said base member can be caused to adhere to the generally vertically disposed supporting surface.

* * * * *